United States Patent [19]

Comeau

[11] Patent Number: 4,492,262

[45] Date of Patent: Jan. 8, 1985

[54] ADJUSTABLE TRAVERSE ROD AND MOTOR DRIVE COMBINATION

[75] Inventor: Paul E. Comeau, Warwick, R.I.

[73] Assignee: Kenney Manufacturing Company, Warwick, R.I.

[21] Appl. No.: 376,203

[22] Filed: May 7, 1982

[51] Int. Cl.[3] ..... A47H 1/00

[52] U.S. Cl. ..... 160/126; 160/331

[58] Field of Search ..... 160/107, 126, 168 R, 160/331

[56] References Cited

U.S. PATENT DOCUMENTS 2,179,763 11/1939 Smolowitz ..... 160/107

3,753,457 8/1973 Bratschi ..... 160/331

4,102,381 7/1978 Bratschi ..... 160/168 R 4,254,815 3/1981 Comeau ..... 160/126

*Primary Examiner*—Peter M. Caun

*Attorney, Agent, or Firm*—Robert B. Russell

[57] ABSTRACT

A telescoping drapery traverse rod is provided with a motor drive without sacrificing any of the simple consumer installation and adjustment features of conventional draw-cord operated traverse rods. It employes a positive-drive perforated-plastic tape and sprocket combination with the tape being releasably secured to the master carriers in a manner analogous to that of the conventional draw cord arrangement.

3 Claims, 17 Drawing Figures

ADJUSTABLE TRAVERSE ROD AND MOTOR DRIVE COMBINATION

FIELD OF THE INVENTION

This invention relates to drapery hardware and more particularly to traverse rods adapted with motors for power driven operation. Still more particularly the invention is concerned with motor driven traverse rods which are of adjustable length so as to fit windows of various sizes and which can be installed by the average consumer in substantially the same way as conventional, non-motor driven traverse rods.

BACKGROUND OF THE INVENTION

Traverse rods are conventionally operated by draw cords which extend downwardly from a pulley case at one end of the rod. When such rods are intended for home installation, they usually are made up of semi-tubular (C or inverted U-shaped in cross section) telescoping sections having a pulley case at each end of the rod, and with the rod being supported at each end by wall brackets. A pair of master carriers control closing and opening the curtain with the draw cord being releasably connected to each. The draw cord forms a loop within the rod over the pulleys at each end with the masters connected respectively to opposite sides of the loop. In this way, pulling the draw cord in one direction opens the curtain while the other direction closes it. The installation and length adjustment of the rod are easily accomplished. First the wall brackets are mounted. Next the rod length is adjusted and the rod is then mounted on the brackets, usually by a simple snap fit. During the length adjustment, the draw cord must be free of one of the master carriers. After the rod has been mounted, the master carriers are then moved to the fully opened position, all slack in the draw cord is removed, and the draw cord is secured to the other master carrier. At this point, the rod is in condition for use, and closing the curtain will bring the two master carriers together at the center of the window (or other opening).

Although there has long been a demand for motor driven traverse rods, and various types have been sold over the years, the previously known motor driven traverse rods have been expensive and have not been suitable for consumer installation, and, as a result such devices have been employed only by professional interior decorators in isolated and high priced installations.

The problems involved are as follows. First, the drive mechanism must be a positive drive in the sense that it cannot slip at any point or else the curtain will not close or open fully. For this reason, in one prior installation, a double threaded worm gear extending the full length of the rod was employed to drive the master carriers. A second problem is that the rod must be readily adjustable in length. This problem is complicated by the need for a positive drive. Obviously, the simple draw cord arrangement of the conventional traverse rod would be unsuitable because there would be inevitable slippage between a motor drive and such a cord. Likewise, the double threaded worm gear arrangement of the prior art would have to be cut and adjusted professionally in the field, and would not be suitable for length adjustment by the average consumer. A third problem related to the ease of installation is that of where to mount the motor and control elements. The prior installation's special arrangements sometimes involving a recess in the adjacent wall, are required.

It is, therefore, an object of this invention to provide a motor driven traverse rod which is relatively inexpensive, in which the drive is completely positive, and which can be adjusted for length during installation, with the same ease as the length adjustment of a conventional telescoping traverse rod. A further object is to adapt a motor drive for combination with a conventional telescoping traverse rod without any need for special measuring, cutting or hiding power or control components, and in which the steps involved in installation are essentially the same as for conventional telescoping traverse rods.

BRIEF DESCRIPTION OF THE INVENTION

In the accomplishment of these and other objects of the invention in a preferred embodiment thereof, a conventional traverse rod is employed in which a pair of inverted U-shaped telescoping semi-tubular members make up the rod. A pulley case is provided at each end, and master carriers (also idlers) are provided to slide longitudinally within the rod. Wall brackets are provided, and, after the rod has been adjusted for length, the rod ends are snapped onto the brackets. For the purpose of motor-driving the master carriers, a motor and control package are mounted on one of the wall brackets behind the pulley case at one end of the rod. A perforated plastic tape is used in place of a draw cord. The tape is formed in a loop within the rod over pulleys at each end and is releasably connected to one of the masters in the same relative positions as in the conventional rod. However, at the motor drive end of the rod, the tape does not exit from the rod, but instead runs over a toothed sprocket with the teeth of the sprocket engaged in positive drive relation with the perforations in the tape. The ends of the tape loop terminate at one of the masters. The other master is simply connected to the tape at an intermediate point on the other side of the loop.

It is a feature of the invention that the motor and control pack are mounted on a conventional wall bracket and occupy a hidden position. The motor is provided with a horizontal, forwardly extending, square drive shaft. When the rod is snapped onto the wall brackets, the drive shaft of the motor fits into an eight cornered hole in the hub of the sprocket. It is a feature of the invention that the sprocket is retained only loosely in the end of the curtain rod so that it is free to shift a small amount when the motor drive shaft is inserted into the hub of the sprocket. This is advantageous because it eliminates the need for accurate registration between the motor and the curtain rod.

Another feature is that the sprocket is provided with a tape guide housing which fits over the sprocket and in which a pair of guide ways serve to guide the tape to and away from the sprocket in the predetermined path leading from and to the pulleys. Thus, when the rod is being assembled for shipment, or if the tape is removed in the field, feeding the tape onto the sprocket is facilitated.

It is a feature of the invention that prior to installation the tape ends pass through one of the masters and out of the rod. During length and master-carrier-position adjustment, the tape slides relative to the master carriers. After the rod has been installed and the master carriers are in the correct position, the tape ends are drawn down from the associated master carrier, placed under moderate tension and secured to the master carrier. Then the protruding excess portions of tape are cut off. At that point the rod is ready for use. The motor is a simple direct current reversing motor. It can now be driven in either direction. A further feature of the invention is that a simple double throw switch can be used to control the motor for opening or closing, and instead of employing complicated switches to limit motion, a simple overload detector deactivates the power supply to the motor in the direction of operation while rendering power available for the motor thereafter to operate in the opposite direction.

BRIEF DESCRIPTION OF THE DRAWINGS

A preferred embodiment of the invention selected for purposes of illustration is shown in the accompanying drawings in which.

DETAILED DESCRIPTION OF THE INVENTION

Figure 2:
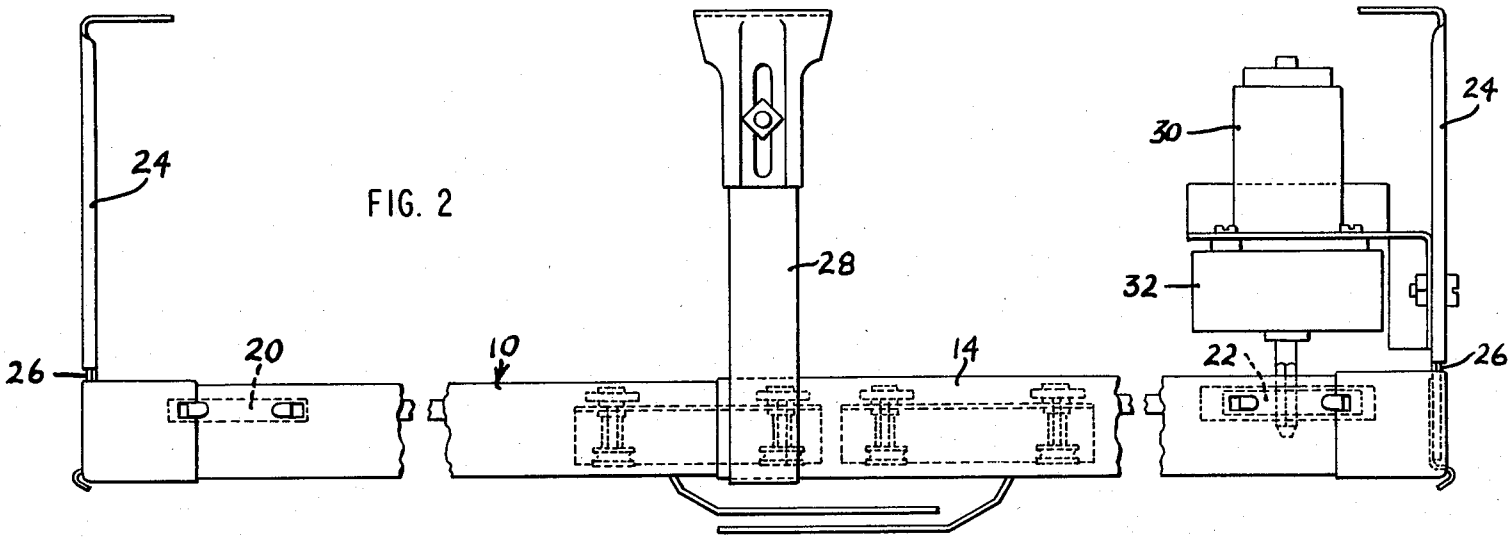
FIG. 2 is a plan view from above of the elements of FIG. 1.
Figure 1:
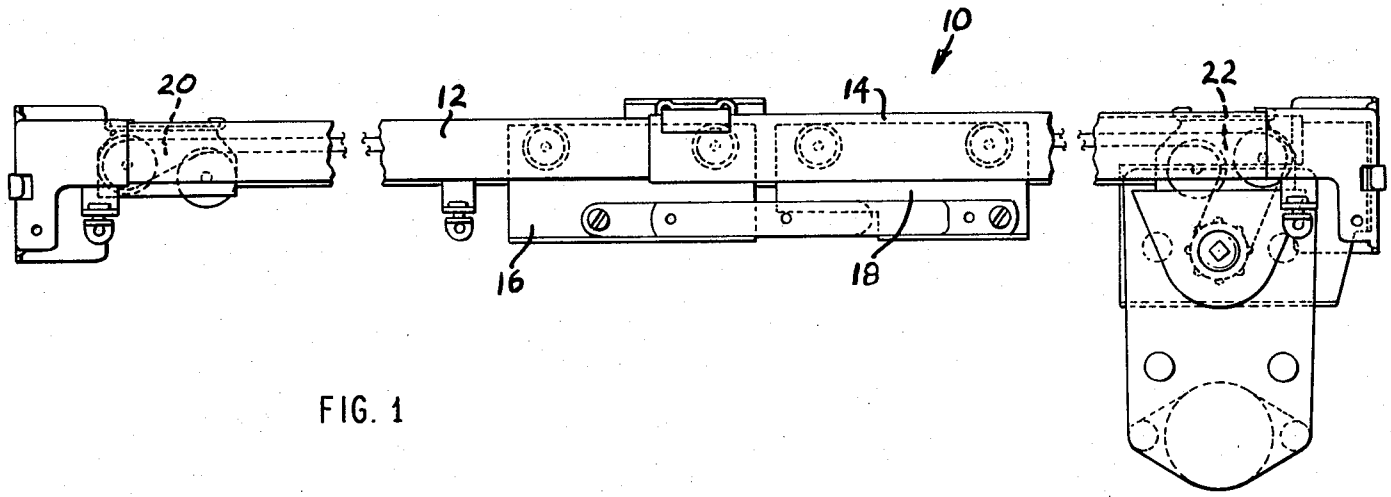
FIG. 1 is a view in front elevation of a traverse rod incorporating the invention, and shown partially broken away in order to abbreviate the length.
Figure 5:
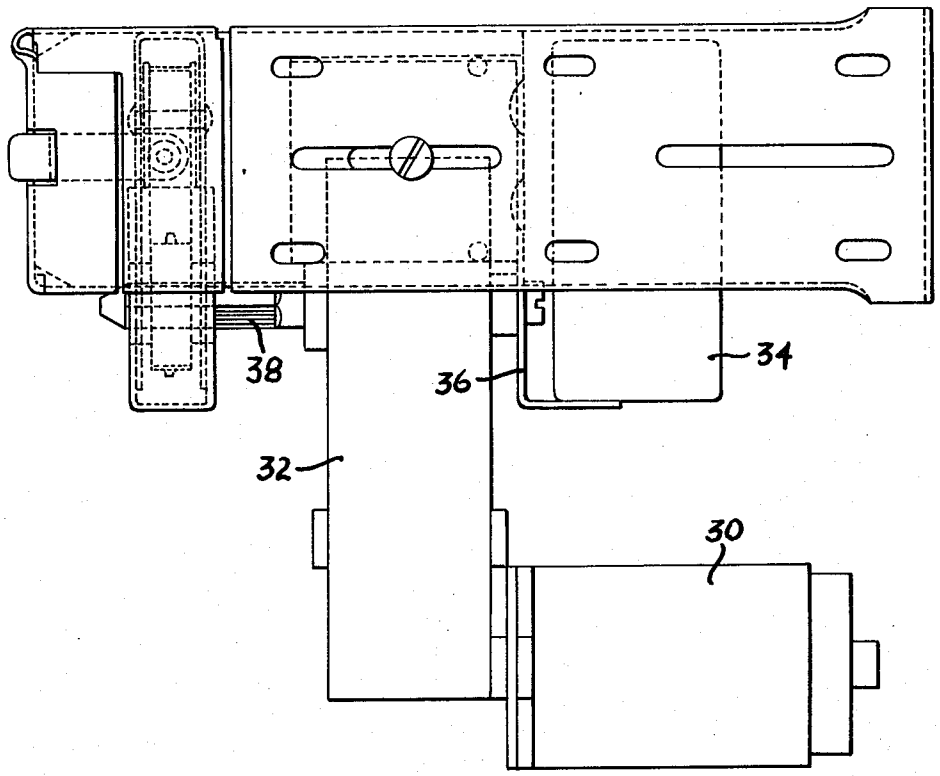
FIG. 5 is an enlarged view in end elevation of the elements of FIG. 4.
Figure 4:
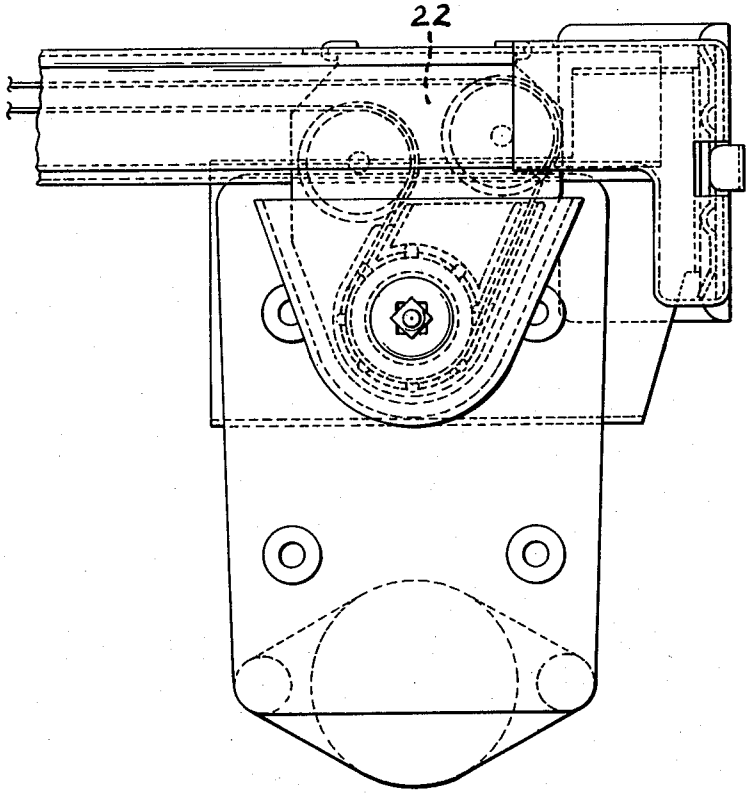
FIG. 4 is an enlarged view in front elevation of the drive end of the curtain rod.
Figure 3:
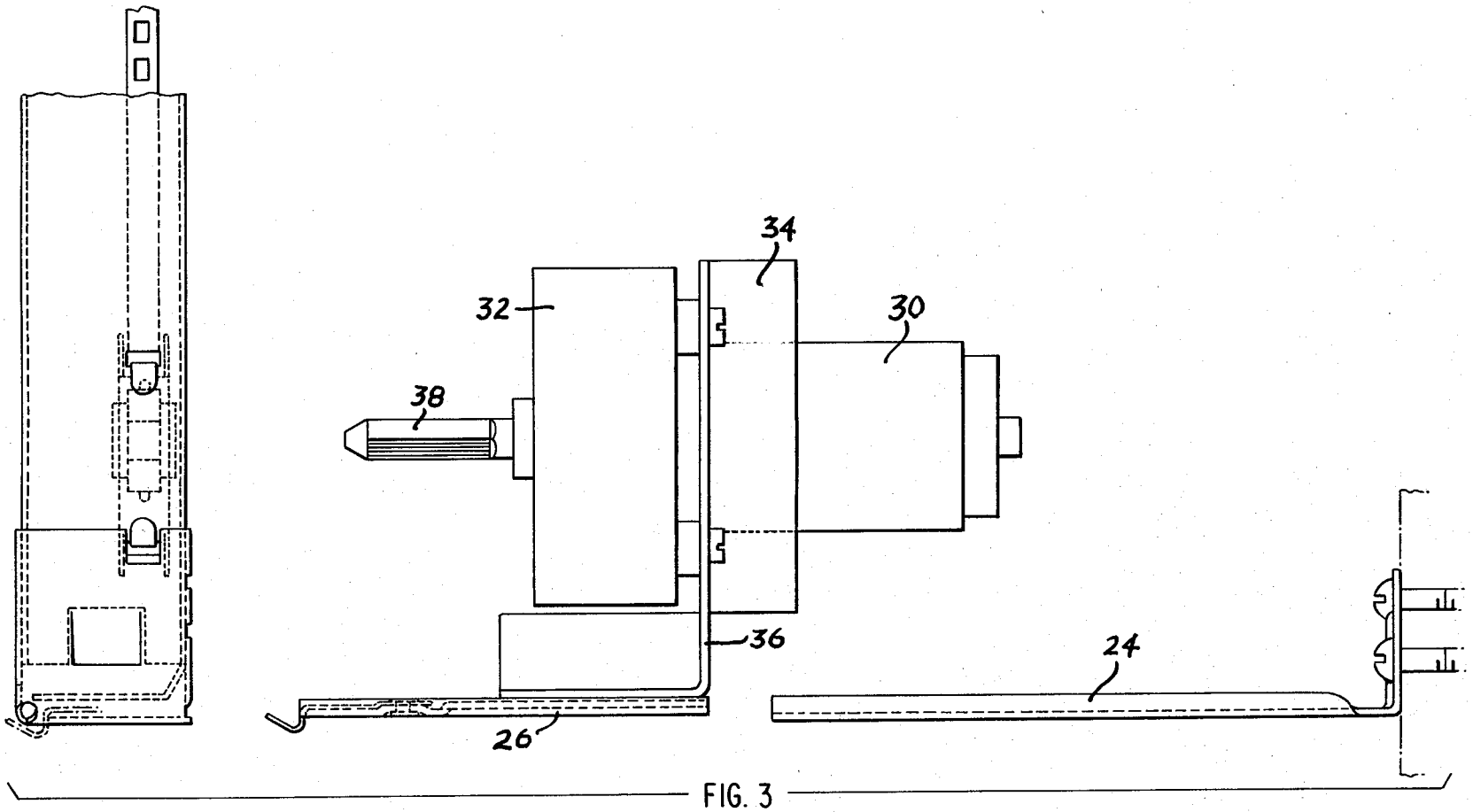
FIG. 3 is an exploded plan view from above of the wall bracket, motor, motor bracket, and drive end of the curtain rod of the invention.

The preferred embodiment of the invention herein shown comprises a hollow, inverted U-shaped curtain rod indicated at 10 including telescoping members 12 and 14. Master carriers 16 and 18 are provided and adapted for sliding or rolling action within and longitudinally of rod 10. Pulley cases 20, and 22 are provided, one at each end of the rod 10. Wall brackets 24 serve to support the rod which snaps onto intermediate slides 26 which in turn are slide-connected to brackets 24 for adjustment of the distance between the rod and the wall. One or more center supports 28 can be employed depending upon the length of the rod and weight of the draperies. Thus far, the components described are all conventional.

The motor drive arrangement includes a motor 30, a reduction gear box 32 and a control package 34. Motor 30, gear box 32 and control 34 are all connected to a motor bracket 36 which is connected to intermediate slides 26. In this way the motor 30 and associated elements are mounted in a convenient place and hidden from view. A square drive shaft 38 protrudes forwardly from gear box 32.

Pulley case 22 is associated with the drive end of the rod (see FIGS. 4 to 8). In the upper end of pulley case 22 are an upper pulley 40 and lower pulley 42. These pulleys can be simple plastic pulleys or provided with ball bearings. They are secured in case 22 by rivets 44. Below pulleys 40, 42 within pulley case 22, a sprocket 46 is mounted within a pair of loosely fitting tape guide housing members 48 and 50. Outside of pulley case 22 in the area of sprocket 46 is a plastic outer housing 52.

The pulley case 22, drive sprocket 46 and associated elements are assembled in the following manner. Pulleys 40–42 are inserted and rivets 44 riveted in place. Next, sprocket 46 with tape guide housing elements 48–50 surrounding it, are snapped up into case 22 by spreading the lower legs of case 22. In this condition, hubs 54 of sprocket 46 protrude outwardly from case 22 through holes 56 in both sides of the lower portion of case 22. Holes 56, however, are significantly larger than hubs 54 such that sprocket 46 is free to slide relative to case 22. Outer housing 52 is then snapped over protruding hubs 54, and pulley case 22 is secured to rod section 14 by means of retaining ears 58. In this condition, when rod 10 is snapped into intermediate slides 26, square drive shaft 38 enters an 8-cornered hole 60 in hub 54. Since sprocket 46 is free to shift, sprocket 46 accommodates its position to that of drive shaft 38, thereby obviating a need for accurate registration between shaft 38 and sprocket 46.

Figure 9:
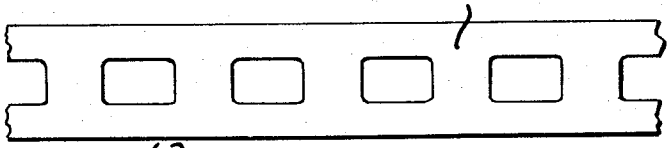
FIG. 9 is an enlarged plan view of the drive tape employed in the invention; and, FIG. 10 is a sectional view along the lines 10—10 of FIG. 9.
Figure 10:
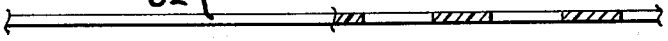
Figure 6A:
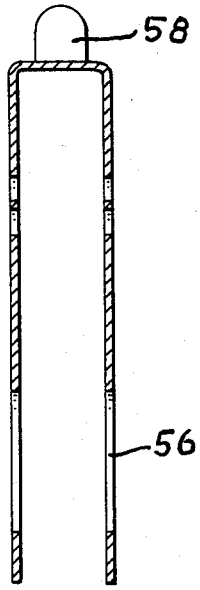
FIGS. 6A to 6H are the various components employed in supporting and housing the drive sprocket at the drive end of the rod.
Figure 6B:
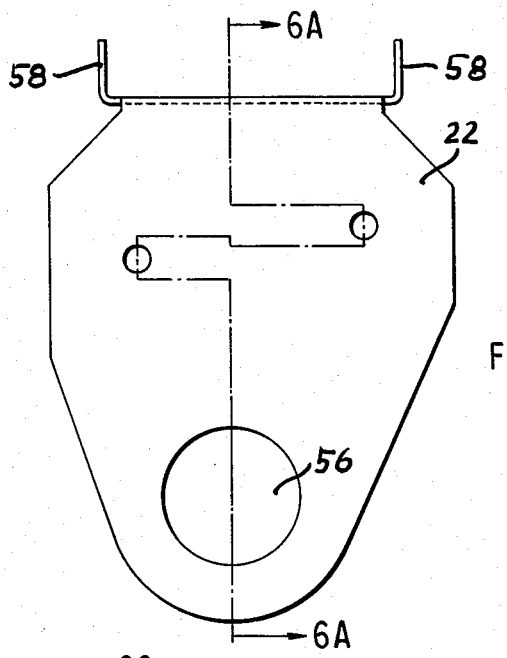
Figure 6C:
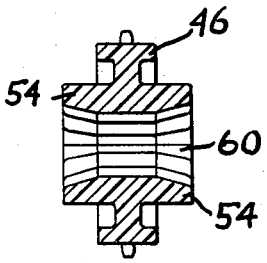
Figure 6D:
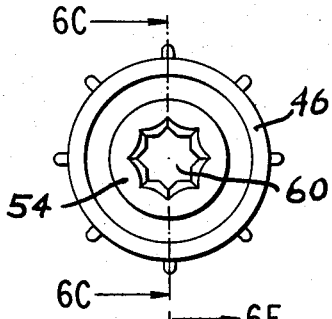
Figure 6E:
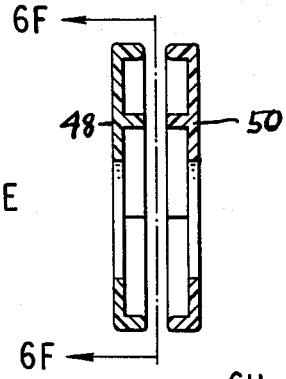
Figure 6F:
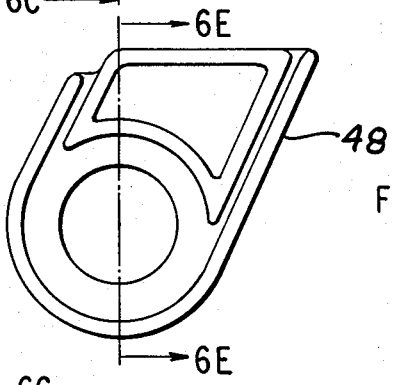
Figure 6G:
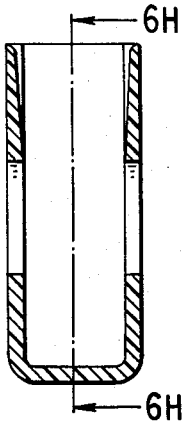
Figure 6H:
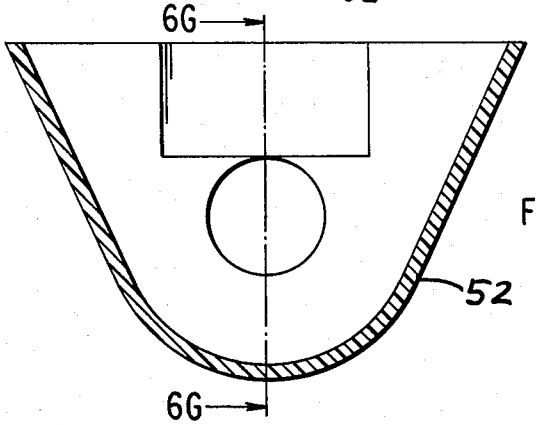
Figure 8:
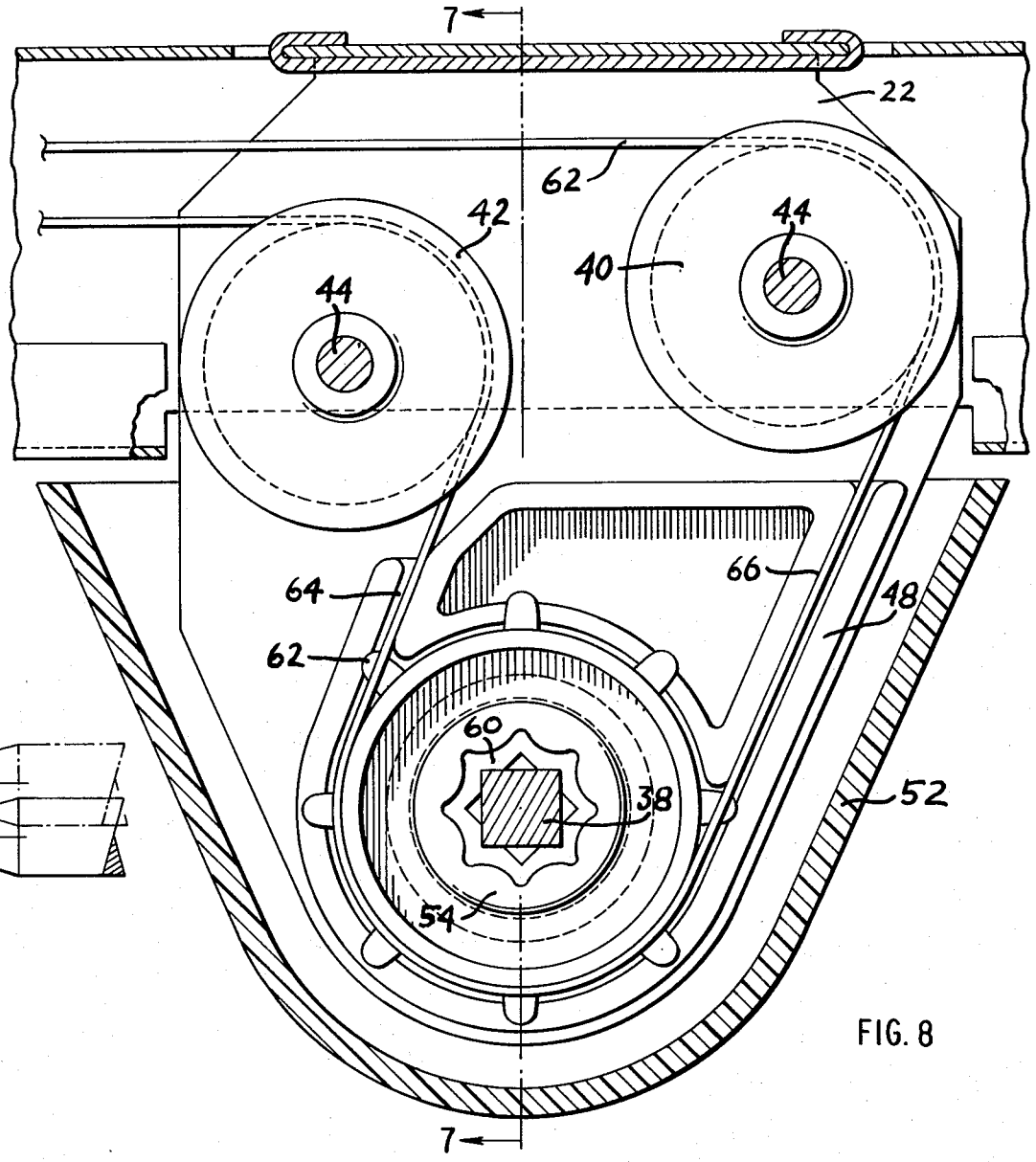
FIG. 8 is a sectional view in front elevation along the lines 8—8 of FIG. 7.
Figure 7:
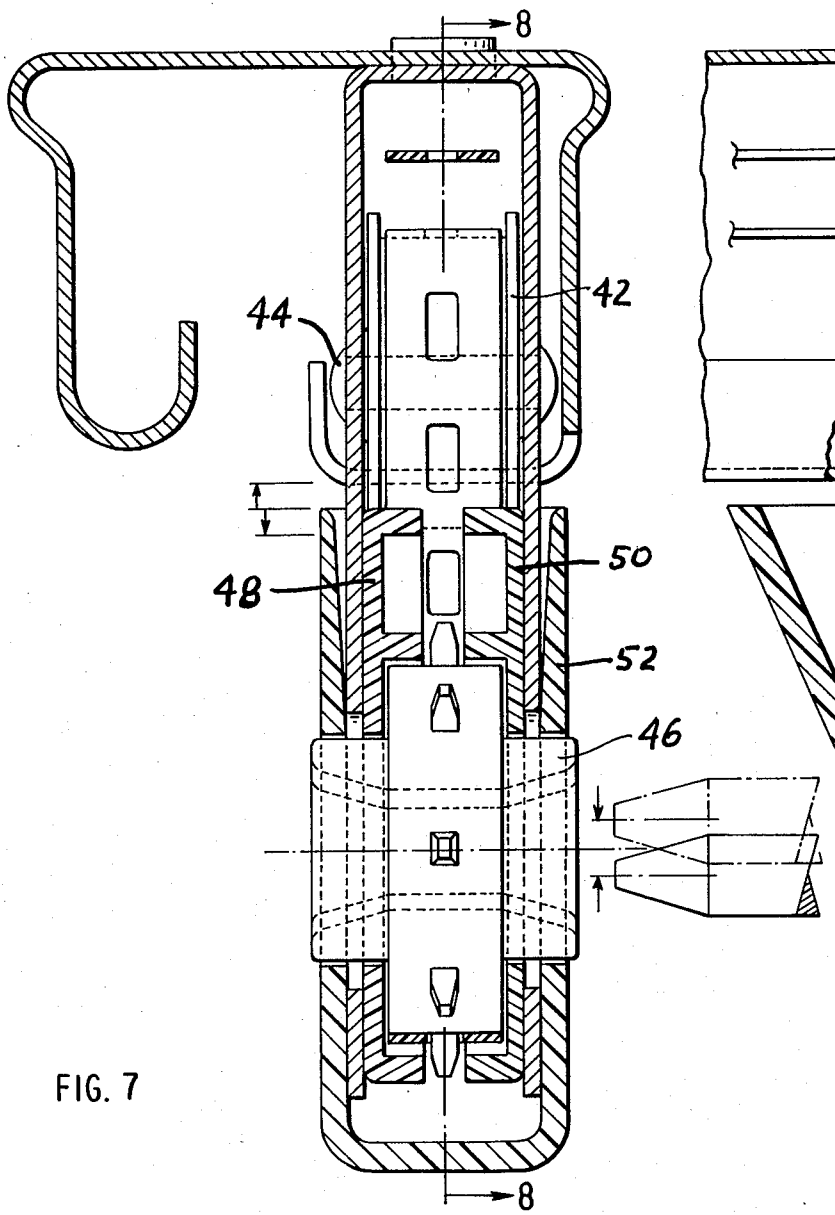
FIG. 7 is a sectional view in end elevation of the drive sprocket (along the lines 7—7 of FIG. 8)

Driving is accomplished by a thin plastic drive tape 62, (see FIGS. 9 and 10). Tape 62 is perforated to match teeth 64 on sprocket 46. At the drive end of the rod tape 62 passes over pulley 42 down through guide housing elements 48–50 into which are formed guide ways 64,66 which lead to (64) and away from (66) the sprocket 46. From guide way 66 the tape 62 runs up and over pulley 40 and back into the rod 10. The means of connecting the tape to the master are not a part of this invention. It will suffice, for the purposes hereof simply to say that the tape is formed into an endless loop within the rod and releasably secured to the master in a manner functionally identical to the draw cord in conventional traverse rods. The important feature for this invention is that at one of the masters the ends of the tape loop are secured to that master thereby forming an endless loop in which all play has been eliminated (under mild tension). Also, the sprocket 46 is contained within that loop. Thus, a positive (nonslipping) drive is provided in an extremely simple and inexpensive manner without sacrificing any of the conveniences of installation and consumer adjustment of the conventional rod as to rod length, rod position, and master carrier positioning.

The electrical control mechanisms are equally simple. Thus, a simple reversing d.c. motor is used with a double throw switch to command the desired direction of operation. An equally simple voltage sensing circuit is used to trigger a control which interrupts power to the motor whenever the motor starts to draw current above a preselected level. In this way complicated limit switches are avoided. The action of the sensing circuit simultaneously makes the power available to drive the motor in the opposite direction whenever that may be desired.

Various modifications of the foregoing will now be apparent to those skilled in the art. For example, a fixed axis sprocket could be used with the motor 30 and associated elements all connected to and supported by pulley case 22. This would sacrifice a number of the features of the preferred embodiment described, but would still remain within the spirit of other basic features of the invention. It is, therefore, not intended that the invention be confined to the precise form herein shown, but to measure it instead in terms of the appended claims.

I claim:

1. A drapery traverse rod and motor drive combination comprising:

(a) a pair of telescoping semi-tubular members forming a curtain rod, (b) a pair of wall brackets, (c) means at the outer ends of said rod for mounting said rod on said brackets, (d) a drive motor, (e) means for mounting said drive motor on one of said brackets, (f) a pair of master carriers mounted in said rod for sliding motion, longitudinally of said rod, (g) a flexible drive tape, (h) pulley means within one outer end of said rod for receiving and guiding said tape, (i) a length of said drive tape with both ends releasably secured to one of said master carriers to form an endless loop within said rod passing from end to end of said rod around said pulleys, said drive tape releasably secured to the other of said master carriers at an intermediate point between the ends of said length of tape, (j) positive drive means on said drive tape, (k) a drive sprocket within said loop of tape engaging said positive drive means on said tape in positive driving relation, and means mounted on one outer end of said rod for retaining said drive sprocket relative thereto but free to slide within narrow limits in a plane normal to the rotational axis of said sprocket, and (l) a drive shaft on said motor for engaging, and supporting said drive sprocket in driving relation to said tape.

2. A motor drive and sprocket combination comprising:

(a) a bracket for mounting said motor in fixed relation to a base, (b) a drive shaft extending from said motor, (c) carrying means for said sprocket, (d) means associated with said carrying means for retaining said sprocket in free sliding relation to said carrying means, in a plane normal to the rotational axis of said sprocket, and (e) means for connecting said carrying means to said bracket with said drive shaft engaging and supporting said sprocket in driving relation on a fixed axis.

3. The motor and drive combination defined in claim 2 further characterized by:

(e) a drive tape for engaging said sprocket in a positive drive relationship, (f) a drive tape guide housing fitting loosely around said sprocket, and (g) guide-ways in said housing for leading said tape to and away from said sprocket in a predetermined path.

* * * * *